US005201516A

United States Patent [19]

Cherian et al.

[11] Patent Number: 5,201,516

[45] Date of Patent: Apr. 13, 1993

[54] SHEET GRIPPING APPARATUS

[75] Inventors: Abraham Cherian, Webster; Roger M. Swanson, Fairport; Eric A. Merz, Penfield, all of N.Y.

[73] Assignee: Xerox Corporation, Stamford, Conn.

[21] Appl. No.: 879,399

[22] Filed: May 7, 1992

[51] Int. Cl.[5] ..... B65H 5/00; B65H 29/04

[52] U.S. Cl. ..... 271/277; 271/204; 294/104

[58] Field of Search ..... 271/277, 204–206, 271/82; 294/104; 198/803.7, 803.8, 803.9, 803.1; 101/408, 409

[56] References Cited

U.S. PATENT DOCUMENTS

| | | | |
|---|---|---|---|
| 2,137,922 | 11/1938 | Mistrett | 294/104 |
| 2,378,478 | 6/1945 | Harless | 101/409 |
| 2,378,523 | 6/1945 | Worthington | 101/409 |
| 2,509,030 | 5/1950 | Banthin | 271/206 |
| 2,906,204 | 9/1959 | Luehrs | 101/409 |
| 4,155,305 | 5/1979 | Heissler et al. | 101/408 |
| 4,501,415 | 2/1985 | Loebach | 271/82 |
| 4,592,279 | 6/1986 | Kemmerer | 101/412 |
| 4,629,176 | 12/1986 | Ceelen | 271/204 |
| 4,647,031 | 3/1987 | Smith et al. | 101/409 |
| 4,846,061 | 7/1989 | Jeschke et al. | 271/206 |
| 4,982,944 | 1/1991 | Eberle | 101/408 |
| 5,075,734 | 12/1991 | Durland et al. | 355/312 |
| 5,128,726 | 7/1992 | Cassano et al. | 271/204 |

*Primary Examiner*—H. Grant Skaggs

*Attorney, Agent, or Firm*—P. J. Maginot; R. Hutter

[57] ABSTRACT

An apparatus for gripping a sheet includes a first gripping member and a second gripping member. The second gripping member includes a base which is movable relative to the first gripping member. The second gripping member further includes a plate which is secured to the base, the plate being adapted to cooperate with the first gripping member to grip the sheet.

14 Claims, 6 Drawing Sheets

SHEET GRIPPING APPARATUS

In accordance with one aspect of the present invention, there is provided an apparatus for gripping a sheet which includes a first gripping member and a second gripping member. The second gripping member includes a base which is movable relative to the first gripping member. The second gripping member further includes a plate which is secured to the base, the plate being adapted to cooperate with the first gripping member to grip the sheet.

Other features of the present invention will become apparent as the following description proceeds and upon reference to the drawings, in which.

Figure 1:
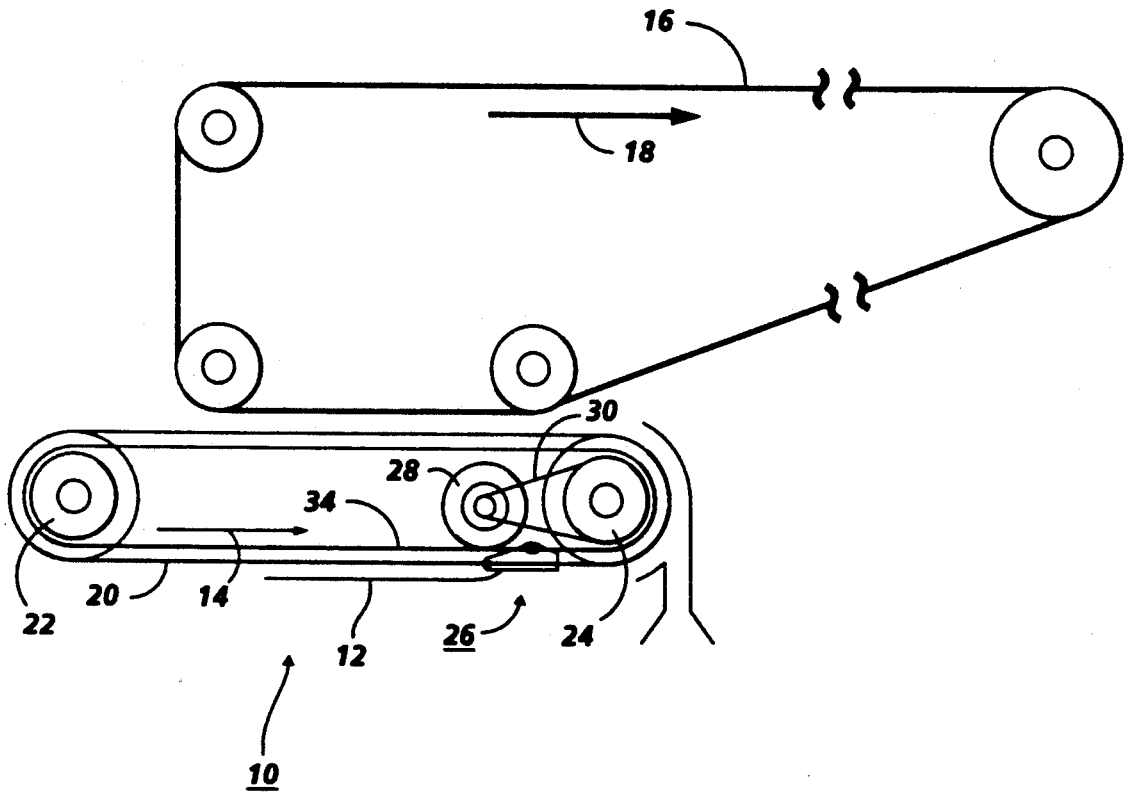
FIG. 1 is a schematic elevational view showing a sheet transport apparatus incorporating the features of the present invention therein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further applications of the principles of the invention as illustrated therein being contemplated as would normally occur to one skilled in the art to which the invention relates.

In FIG. 1 of the drawings, there is shown a sheet transport apparatus, generally indicated by the reference numeral 10. The sheet transport apparatus 10 is shown transporting a sheet 12 in the direction of arrow 14 in a recirculating path of movement. The sheet transport system 10 moves the sheet 12 during a portion of its travel into contact with a photoconductive belt 16 which is itself travelling in the direction of arrow 18. The above arrangement of the sheet transport apparatus 10 and photoconductive belt 16 may be used in an electrophotographic printing machine such as the printing machine described in U.S. Pat. No. 5,075,734 issued to Durland et al., the disclosure of which is hereby incorporated by reference. In addition, the sheet transport apparatus 10 of the present invention has a configuration which is somewhat similar to the sheet transport apparatus described in the above Durland et al. disclosure.

Figure 2:
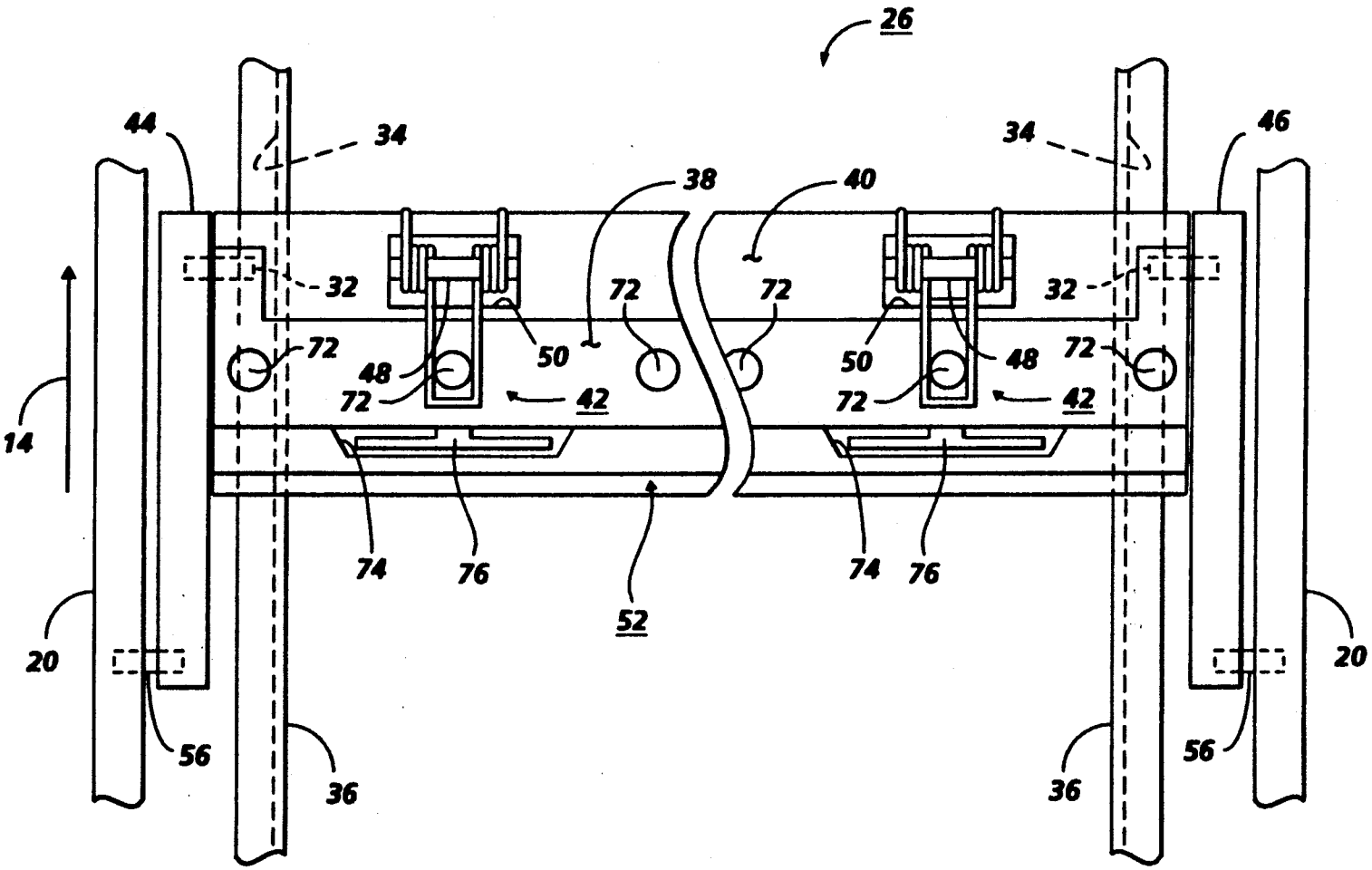
FIG. 2 is a fragmentary planar view showing the sheet gripper used in the sheet transport apparatus of FIG. 1 with the sheet gripper shown to include an upper gripping portion.

The sheet transport apparatus 10 is described below in more detail with reference to FIGS. 1 and 2. In particular, the sheet transport apparatus 10 includes a pair of spaced apart timing belts 20 which are entrained about a pair of substantially cylindrical rollers 22 and 24. A sheet gripper, generally indicated by the reference numeral 26, extends between the belts 20 and moves in unison therewith. The belts 20 define a continuous path of movement of sheet gripper 26. A motor 28 is coupled to roller 24 by a drive belt 30. The sheet gripper 26 includes a pair of guide members 32. A pair of spaced apart and continuous tracks 34 are respectively positioned substantially adjacent to the belts 20. The tracks 34 are respectively defined by a pair of track supports 36. Each of the guide members 32 are slidably positioned with a respective track 34. The sheet gripper 26 further includes an upper gripping portion 38 and a lower gripping portion 40 which are biased toward each other by a plurality of springs, each being generally indicated by the reference numeral 42. The gripping portions 38 and 40 are respectively connected to a pair of gripper supports 44 and 46. A plurality of securing pins 48 are respectively mounted within a plurality of apertures 50 defined in lower gripping portion 40. The securing pins 48 hold the springs 42 in place so as to bias the upper gripping portion 38 toward the lower gripping portion 40.

Figure 3:
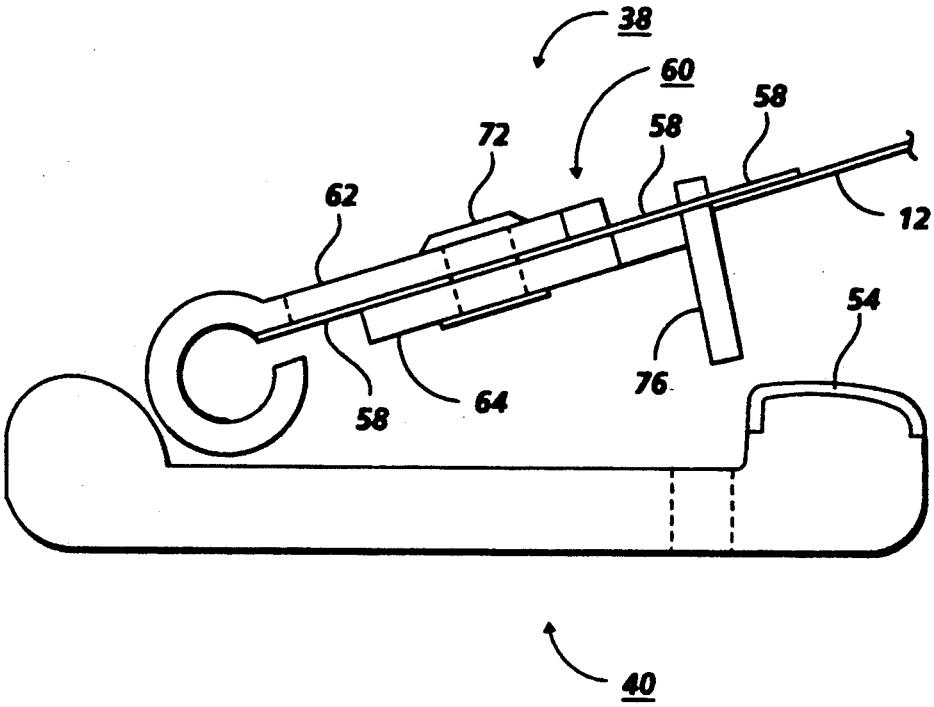
FIG. 3 is a side elevational view of the gripping portions of the sheet gripper used in the sheet transport apparatus of FIG. 1 with the sheet gripper shown in the open position and further showing a sheet positioned within the sheet gripper.
Figure 4:
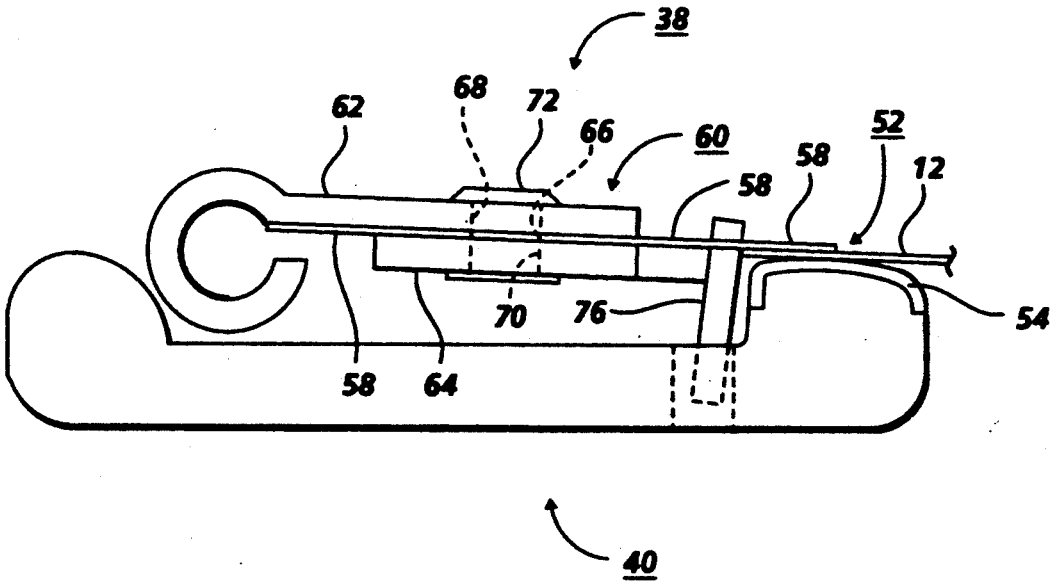
FIG. 4 is a side elevational view of the gripping portions of the sheet gripper used in the sheet transport apparatus of FIG. 1 with the sheet gripper shown in the closed position and further showing a sheet secured within the sheet gripper.
Figure 5:
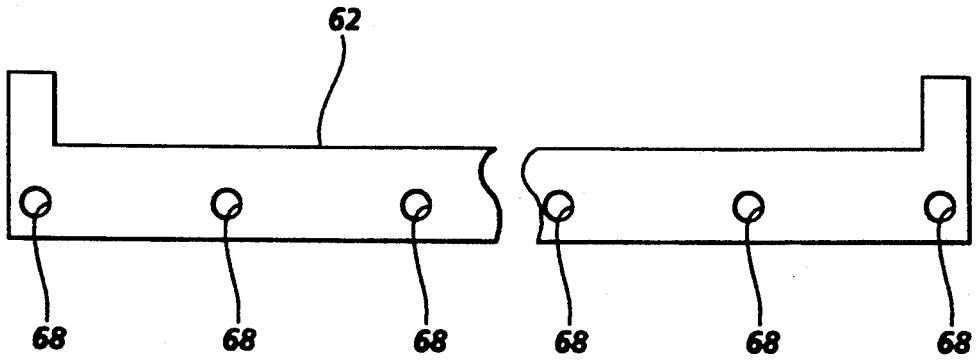
FIG. 5 is a fragmentary planar view of the top member of the base of the upper gripping portion of the sheet gripper used in the sheet transport apparatus of FIG. 1.

The sheet gripper may further include a pair of cam followers (not shown) which are attached to the opposed side marginal regions of the upper gripping portion 38 and function with a pair of cams (not shown) to open and close the gripping portions at predetermined intervals. FIG. 3 shows the orientation of the upper gripping portion 38 relative to the lower gripping portion 40 when the cam followers are actuated to overcome the bias of springs 42. FIG. 4 shows the orientation of the upper gripping portion 38 relative to the lower gripping portion 40 when the cam followers are moved to a non-actuated position. The cam followers are in this position when they are not in contact with the cams. In the closed position, the upper gripping portion 38 cooperates with the lower gripping portion 40 to grasp and securely hold the leading edge of the sheet 12. The area at which the gripping portions 38 and 40 grasp the sheet 12 defines a gripping nip, generally indicated by the reference numeral 52. Positioned upon the lower gripping portion 40, near gripping nip 52, is a silicone rubber coating 54 (see FIGS. 3 and 4). With coating 54 positioned as above, the frictional grip of the sheet 12 between the gripping portions is increased. The belts 20 are respectively connected to the gripper supports 44 and 46 by a pair of pins 56. The belts 20 are connected to the sheet gripper 26 behind the leading edge of the sheet 12 relative to the forward direction of movement of the belts, as indicated by arrow 14, when the sheet 12 is being transported by the sheet transport apparatus 10. The sheet gripper 26 is driven by the belts 20 at the locations where the sheet gripper 26 and the belts 20 are connected.

FIGS. 3–7 show further details of the upper gripping portion 38. More specifically, the upper gripping portion includes a plate member 58 and a base, generally indicated by the reference numeral 60. The base 60 includes a top member 62 and a bottom member 64. The bottom member 64 includes a plurality of stops 76 which function to register the leading edge of the sheet 12 within the sheet gripper 26. The plate member 58 has a plurality of holes 66 defined therein. Moreover, the top member 62 has a plurality of holes 68 defined therein, while the bottom member 64 also has a plurality of holes 70 defined therein. The plate member 58 is interposed between the top member 62 and the bottom member 64 with the holes of each member being respectively aligned with the holes of the other two members. A plurality of rivets 72 are respectively positioned within the space defined by the aligned holes so as to secure the plate member 58 to the base 60 as shown in FIGS. 2–4.

Figure 6:
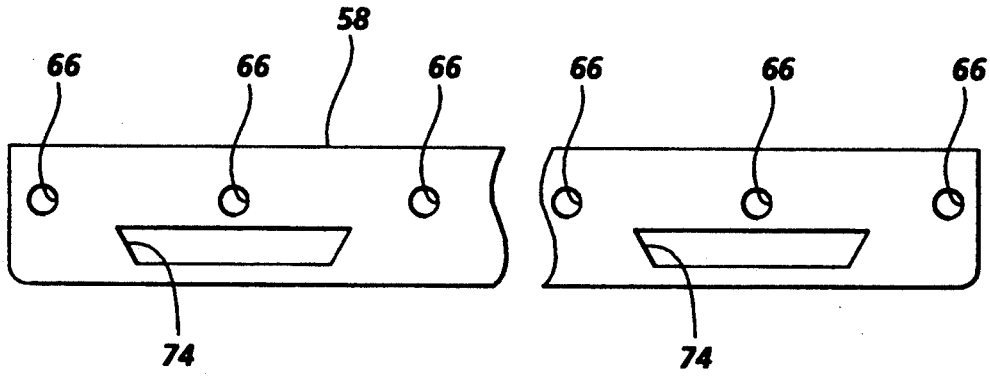
FIG. 6 is a fragmentary planar view of the plate member of the upper gripping portion of the sheet gripper used in the sheet transport apparatus of FIG. 1.
Figure 7:
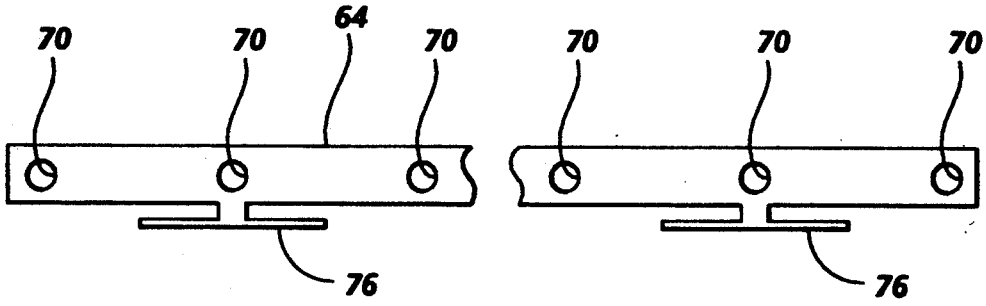
FIG. 7 is a fragmentary planar view of the bottom member of the base of the upper gripping portion of the sheet gripper used in the sheet transport apparatus of FIG. 1.

The plate member 58 is made from sheet metal and the sheet metal is preferably steel. The plate member 58 has a thickness which is less than 0.020 inch and greater than 0.005 inch. Preferably the plate member has a thickness which is less than 0.010 inch. The plate member 58 is substantially planar and has a plurality of apertures 74 defined therein as shown in FIGS. 2 and 6. When positioned as shown in FIGS. 2–4, the plate member substantially spans the width of sheet 12. The top member 62 and the bottom member 64 are made from a cast substance. The cast substance preferably includes a metal such as zinc.

Referring now to FIGS. 8–12, an alternative upper gripping portion 78 is shown. The upper gripping portion 78 may be substituted for the previously described upper gripping portion 38 in the sheet transport apparatus 10 to thereby depict an alternative embodiment of the present invention.

Figure 8:
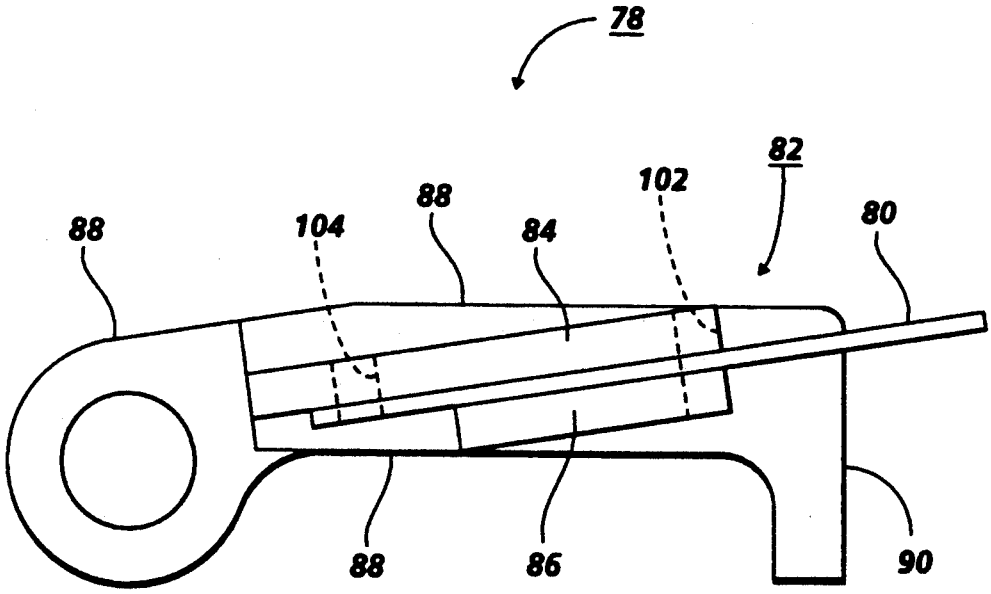
FIG. 8 is side elevational view of an alternative upper gripping portion which may be substituted for the upper gripping portion of FIGS. 2–7 and used in the sheet transport apparatus of FIG. 1 to thereby depict an alternative embodiment of the present invention.
Figure 9:
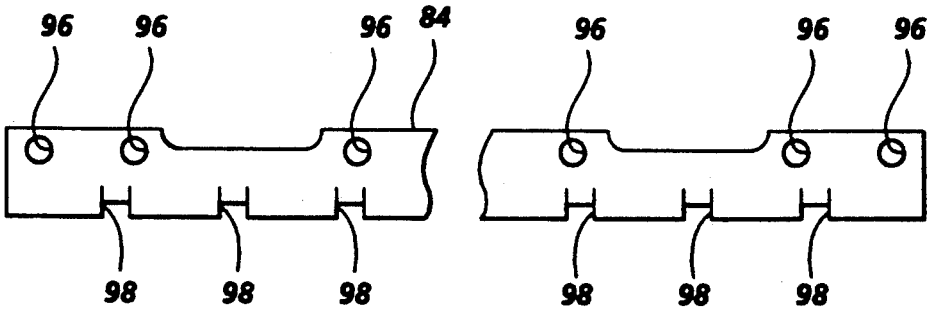
FIG. 9 is a fragmentary planar view of the top member of the base of the upper gripping portion of FIG. 8.
Figure 10:
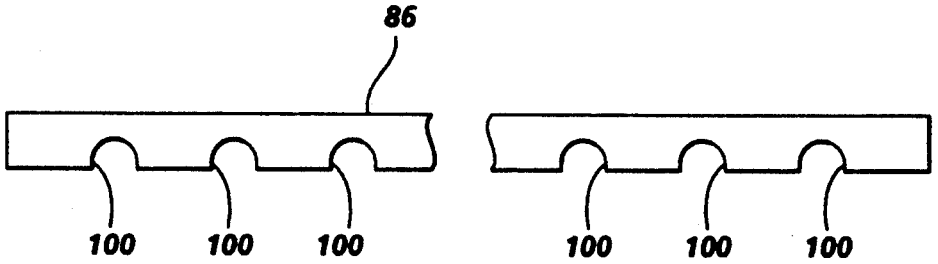
FIG. 10 is a fragmentary planar view of the bottom member of the base of the upper gripping portion of FIG. 8.
Figure 11:
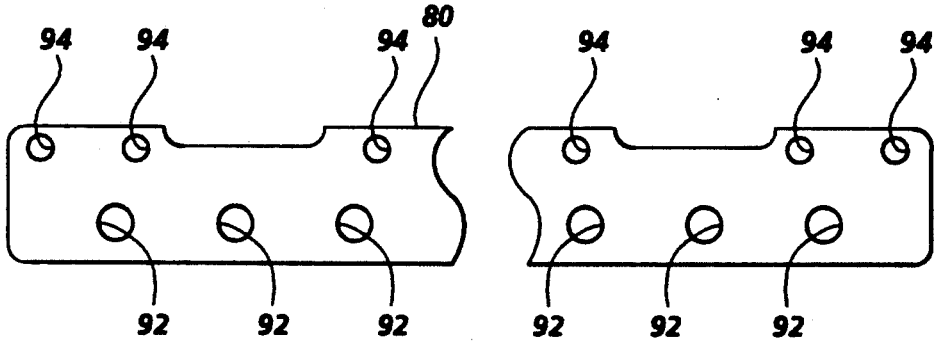
FIG. 11 is a fragmentary planar view of the plate member of the upper gripping portion of FIG. 8.
Figure 12:
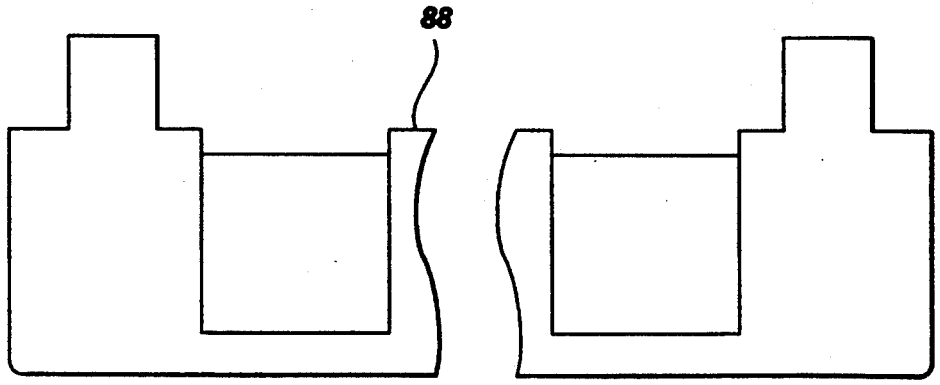
FIG. 12 is a planar view of the cast member of the upper gripping portion of FIG. 8.

The upper gripping portion 78 includes a plate member 80 and a base, generally indicated by the reference numeral 82. The base 82 includes a top member 84, a bottom member 86 and a cast member 88. The cast member 88 includes a plurality of stops 90 which function to register the leading edge of the sheet 12 within the sheet gripper. The plate member 80 has a plurality of first holes 92 and a plurality of second holes 94 defined therein. The top member 84 has a plurality of holes 96 and a plurality of apertures 98 defined therein. The bottom member 86 has a plurality of apertures 100 defined therein. The plate member 80 is interposed between the top member 84 and the bottom member 86 with the first holes 92 of the plate member 80 being respectively aligned with the apertures 98 of the top member 84 and the apertures 100 of the bottom member 86, and further, with the second holes 94 of the plate member 80 being respectively aligned with the holes 96 of the top member 84. The cast member 88 is cast partially around the top member 84, the bottom member 86 and the plate member 80 as shown in FIG. 8 so as to secure the plate member 80 in fixed relation to the base 82. A portion of the cast member 88 occupies a first space 102 defined by the alignment of (i) the first holes 92 of the plate member 80, (ii) the apertures 98 of the top member 84, and (iii) the apertures 100 of the bottom member 86. Another portion of the cast member 88 occupies a second space 104 defined by the alignment of (i) the second holes 94 of the plate member 80, and (ii) the holes 96 of the top member 84.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. An apparatus for gripping a sheet having a first gripping member and a second gripping member movable relative to said first gripping member, the second gripping member comprising:

a base, defining a stop member extending therefrom; and a plate secured to said base, said plate substantially spanning the width of the sheet and being adapted to cooperate with said first gripping member to grip the sheet, said plate defining an aperture therein;

said stop member extending through said aperture in said plate and extending into a zone between said first gripping member and said second gripping member.

2. The apparatus of claim 1, wherein said second gripping member comprises a first elongated member and a second elongated member, a portion of said plate being interposed therebetween.

3. The apparatus of claim 2, wherein said first elongated member and said second elongated member each comprises a metal.

4. The apparatus of claim 3, wherein said metal comprises steel.

5. The apparatus of claim 1, wherein said base substantially spans the width of the sheet.

6. The apparatus of claim 1, wherein said plate is substantially planar.

7. The apparatus of claim 1, wherein said plate comprises a metal.

8. The apparatus of claim 7, wherein said metal comprises steel.

9. The apparatus of claim 1, wherein said plate has a thickness of less than 0.020 inch and greater than 0.005 inch.

10. The apparatus of claim 9, wherein said plate has a thickness of less than 0.010 inch.

11. The apparatus of claim 1, wherein said plate is riveted to said base.

12. The apparatus of claim 1, wherein a portion of said base comprises a cast substance.

13. The apparatus of claim 12, wherein said plate has a plurality of holes defined therein and the cast substance portion of said base is cast within said plurality of holes and around a portion of said base so as to secure said plate to said base.

14. The apparatus of claim 12, wherein said base and said plate each have a plurality of holes defined therein and the cast substance portion of said base is cast within each of said plurality of holes and around a portion of said base so as to secure said plate to said base.

* * * * *